United States Patent [19]

Ely

[11] 4,336,838

[45] Jun. 29, 1982

[54] HEAT EXCHANGE TURBULATOR

[76] Inventor: Richard J. Ely, 10307 S. Quebec Pl., Tulsa, Okla. 74136

[21] Appl. No.: 275,399

[22] Filed: Jun. 19, 1981

[51] Int. Cl.[3] ..... F28F 1/40

[52] U.S. Cl. ..... 165/109 T; 138/38; 165/146

[58] Field of Search ..... 138/38; 165/109 R, 109 T, 165/179, 146; 366/337

[56] References Cited

U.S. PATENT DOCUMENTS

| | | | |
|---|---|---|---|
| 544,152 | 8/1895 | De Benjumea . | |
| 808,752 | 1/1906 | Isaacs et al. . | |
| 1,056,373 | 3/1913 | Segelken . | |
| 1,242,975 | 10/1917 | Planche . | |
| 1,246,583 | 11/1917 | Fulweiler . | |
| 1,272,113 | 7/1918 | Roth . | |
| 1,322,746 | 3/1920 | Oberg . | |
| 1,349,571 | 8/1920 | Hubbard . | |
| 1,459,024 | 6/1923 | Hartburg . | |
| 1,540,535 | 6/1925 | Burke . | |
| 1,707,812 | 4/1929 | Lynch . | |
| 1,770,208 | 7/1930 | Kemnal . | |
| 1,948,064 | 2/1934 | Cartter . | |
| 1,961,744 | 6/1934 | Durkee . | |
| 2,064,080 | 12/1936 | Powers . | |
| 2,070,427 | 2/1937 | Faunce . | |
| 2,079,104 | 5/1937 | Brandt . | |
| 2,144,506 | 1/1939 | Potter . | |
| 2,161,887 | 6/1939 | Ramsaur . | |
| 2,587,530 | 2/1952 | Rossi . | |
| 2,591,398 | 4/1952 | Brock . | |
| 2,640,194 | 5/1953 | Hytte . | |
| 2,641,206 | 6/1953 | Stout . | |
| 2,660,198 | 11/1953 | Morrow . | |
| 2,691,281 | 10/1954 | Phillips . | |
| 2,691,991 | 10/1954 | Schutt et al. | 165/109 T |
| 3,185,143 | 5/1955 | Wilson . | |
| 3,235,003 | 2/1966 | Smith | 165/179 X |
| 4,009,751 | 3/1977 | Zelnick . | |
| 4,044,796 | 8/1977 | Smick . | |
| 4,137,744 | 2/1979 | Smick . | |
| 4,296,779 | 10/1981 | Smick | 165/179 X |

*Primary Examiner*—Sheldon J. Richter

*Attorney, Agent, or Firm*—Stevens, Davis, Miller & Mosher

[57] ABSTRACT

A turbulator for heat exchange tubes made of two metal strips. Each metal strip is formed into a plurality of turbulence nodules which are preferably V-shaped and alternately extend in two different directions. The two metal strips are connected to each other at the places of joinder of the turbulence nodules, providing an end view of generally X-shaped configuration. The alternating pairs of turbulence nodules provide an enhanced buffeting action and heat exchange without an undesirable excessive pressure drop. In the preferred embodiment, each metal strip is tapered having a narrow end tapering to a relatively wide end.

10 Claims, 7 Drawing Figures

HEAT EXCHANGE TURBULATOR

BACKGROUND OF THE INVENTION

1. Field of the Invention

This invention relates to turbulators, and more particularly to turbulators for disturbing an exhaust gas flow in heat exchange tubes.

2. Description of the Prior Art

In the past, turbulators have imparted a swirling motion to gasses flowing through tubes, decreasing the efficiency of heat exchange. These turbulators also have caused a relatively large pressure drop over the length of the tube for the turbulence produced, making them less useful.

SUMMARY OF THE INVENTION

It is an object of this invention to provide a turbulator which increases heat exchange without an overly large pressure drop.

It is a further object of this invention to provide a turbulator which can be adopted to provide the largest possible turbulence within the parameters dictated by the pressure drop which can be sustained by the equipment in which the turbulator is used.

It is a still further object of this invention to provide a turbulator which maximizes heat transfer to the heat exchange tube wall by means of convection and minimizes conductive heat transfer by means of metal to metal contact from the turbulator to the heat exchange tube.

It is a still further object of this invention to provide a turbulator which can be adapted to be used in heat exchange tubes of any diameter.

The above objects and others are obtained by providing a turbulator made up of two substantially identical strips. Each strip is formed into a plurality of turbulence nodules, preferably of a V-shaped longitudinal cross-section. One group of nodules extends in a first direction and a second group of nodules extends in a second direction from the axis of the strip. Members of the first group of nodules alternate with members of the second group the length of the strip. The two strips are connected to each other at the points of contact of the nodules.

DESCRIPTION OF A PREFERRED EMBODIMENT

Figure 3:
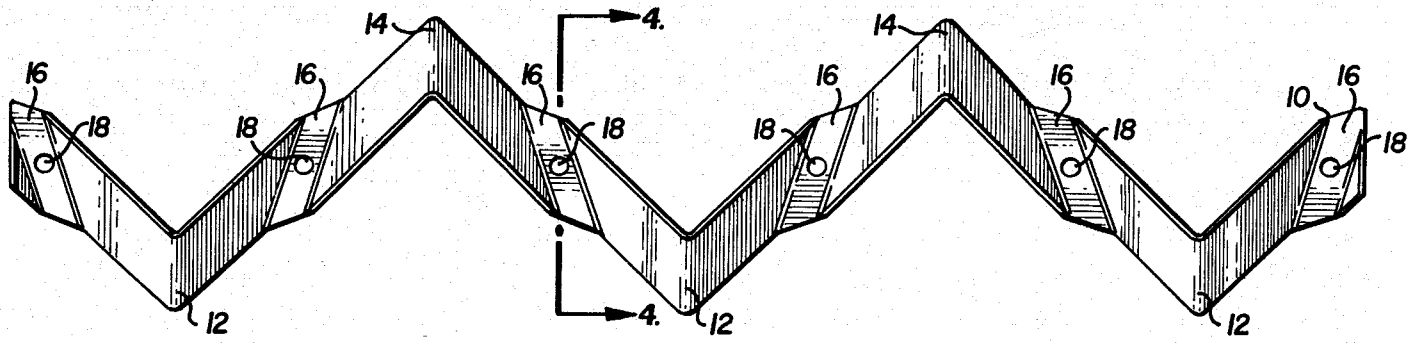
FIG. 3 is a view of one of the strips which makes up the turbulator of the present invention.
Figure 4:
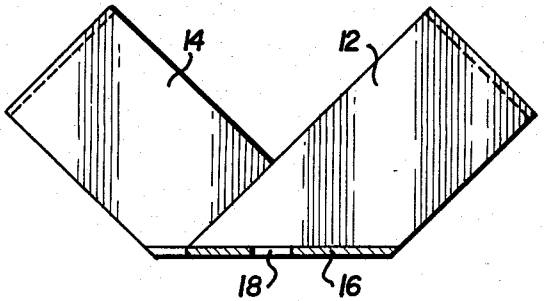
FIG. 4 is a sectional side view taken along line 4—4 of FIG. 3.
Figure 1:
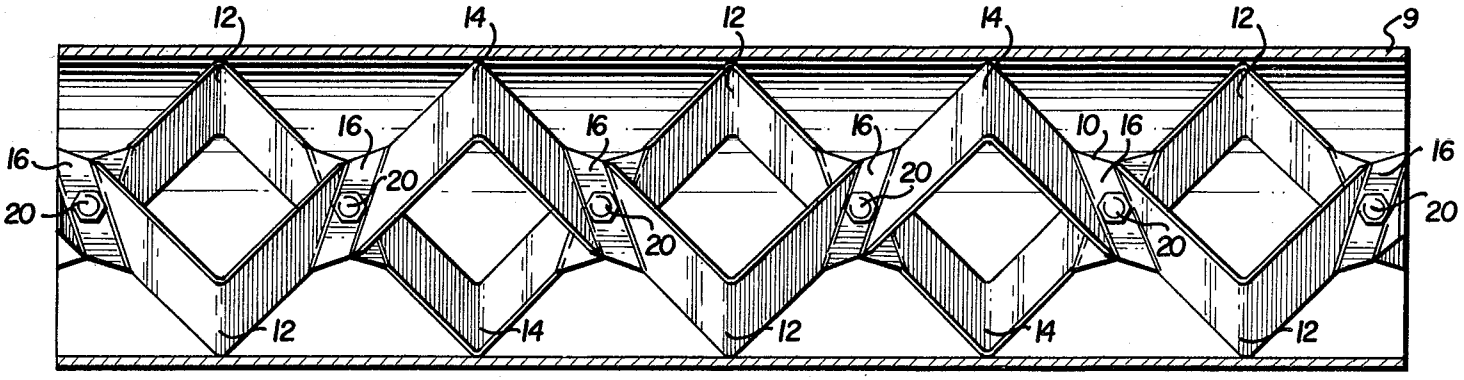
FIG. 1 illustrates the tubulator of the present invention disposed within an heat exchange tube.

Referring to the drawings, FIG. 1 shows a heat exchange tube 9 equipped with a turbulator of the present invention. The turbulator comprises two substantially identical strips 10, one of which is shown in FIGS. 3 and 4.

Figure 5:
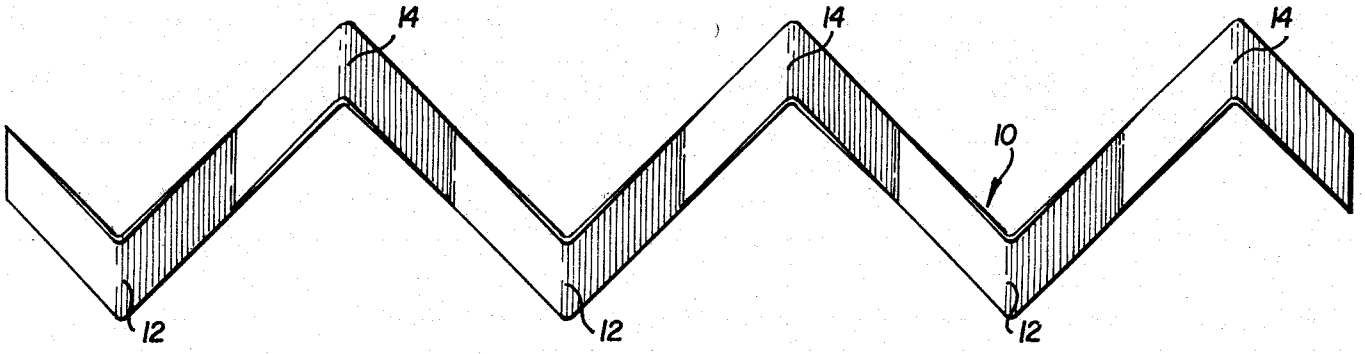
FIG. 5 shows a view similar to FIG. 3 of another embodiment of one of the strips.
Figure 6:
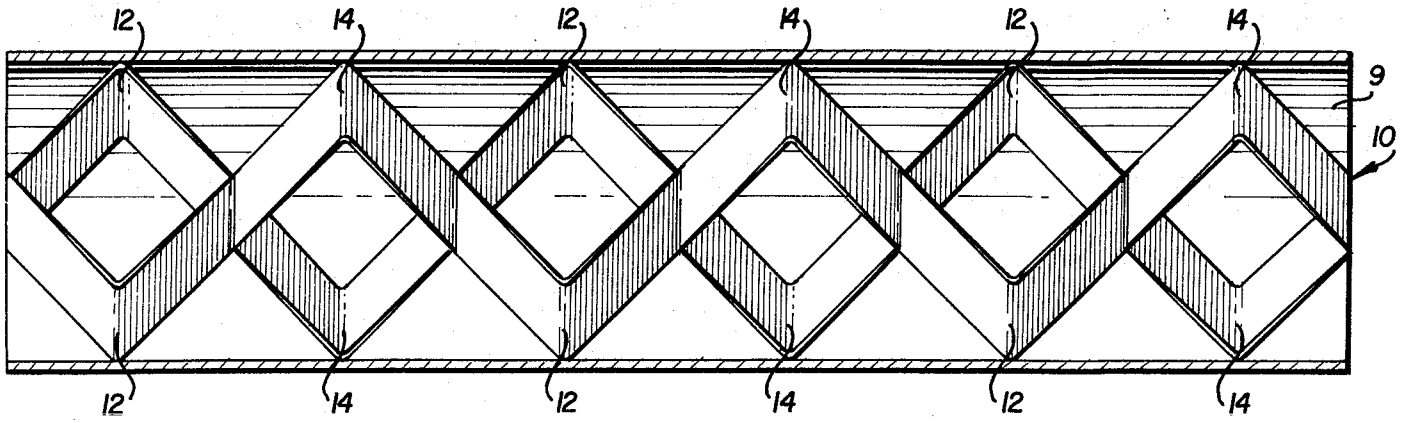
FIG. 6 shows a view similar to FIG. 1 of the turbulator formed with strips as shown in FIG. 5.

Each strip 10 is formed into two sets of turbulence nodules 12 and 14. The turbulence nodules 12 extend in a first direction from the axis of the strip, and the nodules 14 extend in a second direction from the axis of the strip. In a preferred embodiment, the two sets of nodules extend in directions perpendicular to each other. Nodules 12 extending in the first given direction alternate with nodules 14 extending in the second given direction. Adjacent nodules of two strips comprising a whole turbulator may be joined at their mutually touching points or areas. In one preferred embodiment adjacent nodules are joined at intersecting flat ridges 16 through which extend apertures 18. In another embodiment, the ridges 16 need not be flat, but may simply comprise a V-bend in the strip. This embodiment is shown in FIGS. 5 and 6. In this embodiment the intersections between adjacent strips are essentially points. As illustrated in the drawings, the turbulence nodules are preferably of a V-shaped longitudinal cross section. The strips are preferably made of mild, aluminized, or stainless steel, although other materials are also suitable.

Figure 2:
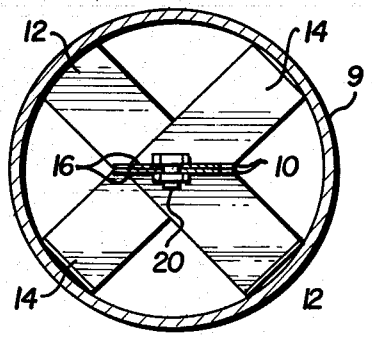
FIG. 2 is an end view of the heat exchange tube of FIG. 1.

The turbulator is formed by connecting the two metal strips 10 to each other at ridges 16. One preferable means of connecting the two strips is a nut and bolt assembly as indicated by number 20 in FIGS. 1 and 2. Other methods of joinder well known in the art, such as riveting or welding, are also useable in this invention. Welding is particularly useful for the embodiment of FIG. 6. The turbulator can be retained in the heat exchanger tube 9 by any suitable means such as having an end portion of the turbulator extend outside of and hooked over the end of the heat exchange tube when the tube is vertical. When the tube is horizontal, the weight of the turbulator is sufficient to hold it in place. As can be seen in FIG. 2, the completed turbulator has a generally X-shaped configuration when viewed from the end of the heat exchanger tube.

The size of the turbulence nodules 12 and 14 can be varied so as to allow the turbulator to be used with heat exchange tubes of any diameter. By varying the angle subtended by each turbulence nodule, the number of turbulence nodules for a given length of tube can be increased or decreased. Increasing the number of turbulence nodules increases the heat exchange capacity but also increases the overall pressure drop over the length of the tube. Decreasing the number of nodules will have the opposite effects. By varying the angles subtended by each turbulence nodule, the greatest number of turbulence nodules possible without an unacceptable overall pressure drop can be utilized in a given heat exchange tube.

Figure 7:
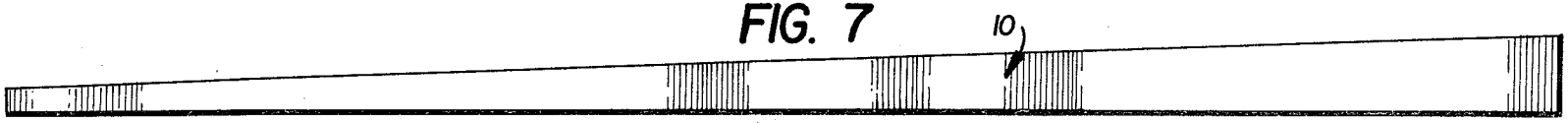
FIG. 7 shows a preferred embodiment of a strip similar to those shown in FIGS. 3 and 5, prior to bending.

In the embodiment of FIG. 7, each metal strip 10 is provided with a wide end and a narrow end. FIG. 7 shows a strip prior to bending. The narrow end of one strip should be attached to or near the narrow end of the other strip, and similarly for the wide ends. The narrow end is meant to be provided at the flue gas inlet of the heat exchange tube and the wide end at the flue gas outlet. This arrangement provides maximum heat exchange with minimum pressure drop. As the relatively hot flue gas enters the tube, the amount of buffeting necessary for good heat exchange is smaller than that required at the tube outlet, where the gas is relatively cooler. Having the width of the metal strips gradually increase over the length of the tube generally increases the amount of buffeting and turbulence. The strip of FIG. 7 can be bent to a form as shown in either FIG. 3 or FIG. 5. Of course, the height of each nodule may have to be progressively slightly decreased to accommodate the progressively wider strip in a tube of constant diameter. The height decrease is of a relatively minor significance in most applications.

It has been discovered that having two sets of alternating nodules which extend in different directions from the axis of the turbulator creates minimal pressure drops and provides maximum turbulence. Hot gases alternately bump into these staggered nodules as they flow through the tube. This creates a high turbulence and increases the efficiency of disturbing the laminar boundary layer flow along the wall of the tube, creating maximum heat transfer from the gasses to the tube. The design of the metal strips allows the assembled turbulator to form essentially an "X" configuration to provide uniform turbulence around the entire circumference of the tube as the gases pass through. The turbulence provided is a random buffeting, which is superior to the swirling or twisting gas flows provided in other turbulators.

The improved heat exchange provided by the turbulator of the present invention is almost totally from turbulence as opposed to metal contact with the tube wall. This can be seen by reference to FIG. 2, which shows that the turbulator contacts the tube walls only at the corner points of the turbulence nodules. This also serves to hold the turbulator symmetrically within the heat exchange tube, again providing excellent turbulence around the entire circumference of the tube.

It is preferred that the turbulator be made of a metal similar to that of the tube and be of a thickness less than that of the tube wall. This prevents the creation of hot spots on the tube wall since the turbulator would overheat first and flatten before the thicker tube wall could become over-stressed.

While it is believed that the majority of applications of this invention will be for turbulators made of metal, it is clear that for special uses, the turbulator may be made of fiberglass reinforced plastic, carbide compositions or others, depending upon the particular needs of the specific situation.

Although a particular preferred embodiments have been described, it is clear that one skilled in the art could modify this preferred embodiment without departing from the spirit and scope of the invention.

What is claimed is:

1. A turbulator for insertion in a heat exchange tube comprising two formed strips in contact with each other at places in a plane which includes the axis of the turbulator, each strip being formed into a plurality of turbulence nodules, said nodules comprising a first group of nodules extending in a first direction from the axis of the turbulator and a second group of nodules extending in a second direction from the axis of the turbulator, said directions being substantially perpendicular to each other, members of said first group alternating with members of said second group along the length of each strip, said strips being connected to each other at the places of contact between said strips.

2. The turbulator of claim 1, wherein each of said turbulence nodules comprises a V-shaped bend in one of said strips.

3. The turbulator of claim 2, wherein the V-shaped nodules comprise at their apexes a bend along a line substantially perpendicular to the axis of the turbulator, with the portions of the strip immediately adjacent said bend line being approximately perpendicular to each other.

4. The turbulator of claim 2 wherein the contact places at which said strips are joined to each other each comprises a substantially flat plateau portion of the strip at the end of each leg of the V-shape, said metal strips being connected to each other at said flat portions so as to provide an end view of substantially X-shaped configuration.

5. The turbulator of claim 1 wherein each strip is of a uniform thickness which is less than the thickness of the wall of an heat exchange tube into which it is to be inserted.

6. The turbulator of claim 1 wherein each strip is provided with a narrow end and a wide end and gradually increases in width from said narrow end to said wide end, said narrow ends of each strip being located near each other.

7. The turbulator of claim 1 in combination with, and located within a tube.

8. The turbulator of claim 1 wherein said turbulator is made of metal.

9. The turbulator of claim 7 wherein said turbulator and said tube are made of metal.

10. The turbulator of claim 6 in combination with and located within a tube having a gas inlet and a gas outlet, the narrow ends of said strips being located near the gas inlet, and the wide ends near the gas outlet.

* * * * *